United States Patent [19]

Smolinski et al.

[11] 4,184,821

[45] Jan. 22, 1980

[54] HIGH VELOCITY ROTARY VANE COOLING SYSTEM

[76] Inventors: Ronald E. Smolinski, 4081 Forest Ridge Blvd., Dayton, Ohio 45424; Kenneth P. Schwartz, 2604 N. Emerald, Fairborn, Ohio 45324

[21] Appl. No.: 932,812

[22] Filed: Aug. 10, 1978

[51] Int. Cl.[2] ..... F04C 29/02

[52] U.S. Cl. ..... 418/93; 418/152; 418/264

[58] Field of Search ..... 418/152, 264

[56] References Cited

U.S. PATENT DOCUMENTS

| | | | |
|---|---|---|---|
| 2,498,029 | 2/1950 | Clerc | 418/264 |
| 2,672,282 | 3/1954 | Novas | 418/152 X |
| 3,001,482 | 9/1961 | Osborn | 418/264 X |
| 3,568,645 | 3/1971 | Grimm | 418/264 |
| 3,809,020 | 5/1974 | Takitani | 418/152 X |
| 3,904,327 | 9/1975 | Edwards et al. | 418/152 X |
| 4,088,426 | 5/1978 | Edwards | 418/152 X |

*Primary Examiner*—Leonard E. Smith

*Attorney, Agent, or Firm*—Joseph E. Rusz; Richard J. Killoren

[57] ABSTRACT

A reverse Brayton cycle rotary vane cooling system having a compressor and an expander driven by a common shaft. The cooling system includes a plurality of vanes made of a carbon epoxy plastic composite with bearing support inserts molded into the plastic composite. A bolt passes through the bearing support inserts and plastic composite. Oil is supplied to the vane slots with any oil passing into the cooling gas being removed by oil separators.

3 Claims, 3 Drawing Figures

HIGH VELOCITY ROTARY VANE COOLING SYSTEM

RIGHTS OF THE GOVERNMENT

The invention described herein may be manufactured and used by or for the Government of the United States for all governmental purposes without the payment of any royalty.

BACKGROUND OF THE INVENTION

This invention relates to a rotary vane reverse Brayton cycle cooling system.

The U.S. Pat. Nos. to Edwards, 3,686,893; 3,913,351; and 3,977,852, describe cooling systems which operate on a reverse Brayton cycle. The article "Performance of a New Positive-Displacement Air Cycle Machine" by R. E. Smolinski and Dr. L. L. Midolo given at an American Institute of Aeronautics and Astronautics Conference, Sept. 27, 1976, describes an air cycle machine wherein the vanes are supported on bearings which ride on a cam track to take up the radial vane loads.

In environmental control systems for aircraft it is desirable to obtain maximum cooling with minimum weight or to have a high cooling/weight ratio. In a reverse Brayton cycle cooling system more cooling for the same physical volume can be obtained by operating the device at higher velocities. Increasing the velocity of prior art vanes causes greater deflection of the vanes and increased bearing wear and could cause destruction of the apparatus. The Aeronautics and Astronautics Conference article suggests the use of featherweight vanes. However, many light weight materials will bend at high velocities and would contact the chamber wall and result in intolerable wear on the vanes. Most high strength light weight materials are abrasive and have poor wear characteristics.

BRIEF SUMMARY OF THE INVENTION

According to this invention vanes for a rotary vane reverse Brayton cycle cooling system are provided which have the vanes constructed of carbon epoxy plastic composite material with steel axle members being molded into the carbon epoxy material. The axle members are interconnected by means of a rod passing through the vane member. Ball bearings are used with the device of the invention to reduce the load on the vanes. Oil is supplied to the vane slots to reduce wear on the vanes.

IN THE DRAWING

DETAILED DESCRIPTION OF THE INVENTION

Figure 1:
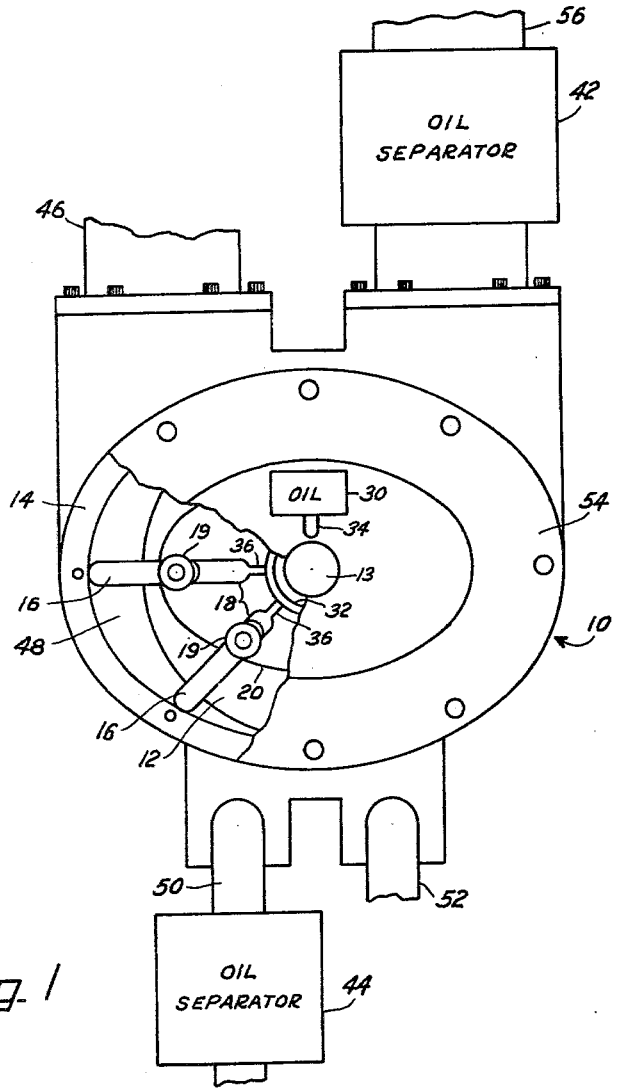
FIG. 1 is a partially schematic view of an conventional reverse Brayton cycle rotary vane cooling system modified according to the invention.

Reference is now made to FIG. 1 of the drawing which shows a rotary gas cycle cooling system 10 having a rotor 12 on a shaft 13 within a housing 14. The rotor 12 includes a plurality of vanes 16 which slide in slots 18, as in a conventional rotary vane cooling system. The vanes are supported on bearings 19 which ride on vane guide cams 20.

Figure 2:
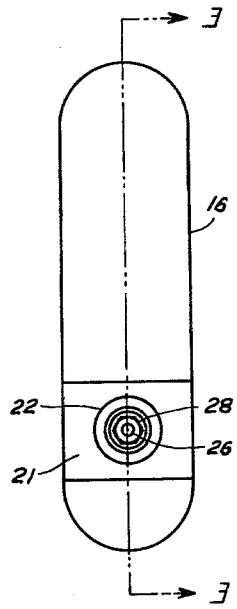
FIG. 2 is an end view of a vane used in the device of FIG. 1.
Figure 3:
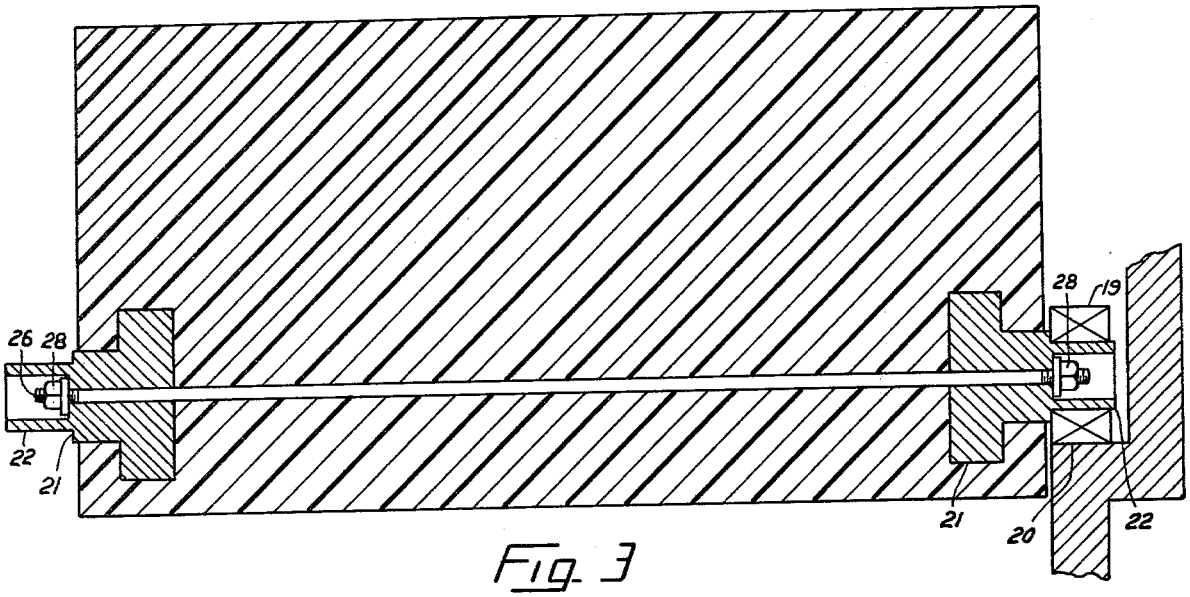
FIG. 3 is a partially schematic sectional view of the device of FIG. 2 with bearing and cam members added.

The vanes 16 are constructed as shown in FIGS. 2 and 3. The vanes are made of a low density, high modulus of elasticity carbon epoxy plastic composite, such as GY-70 Epoxy, made by the Celanese Corporation, molded around bearing support inserts 21. The bearing support inserts include journal members 22, for receiving bearing members 19. Ball bearings are used for bearings 19 to reduce the load on the vanes. A rod member 26 passes through the vane and is secured by nuts 28. To reduce friction and wear on the vane members oil is supplied to the slots 18 from a supply 30. The oil passes to annular channel 32 from tube 34 and from channel 32 to vane slots 18 through passages 36. Since oil in slots 18 will pass into the cooling gas in housing 14 it is necessary to remove the oil from the cooling gas before the gas passes to the heat exchangers, not shown. To remove the oil from the gas, the gas is passed through oil separators 42 and 44 before passing to the heat exchangers. The oil separators can be conventional vortex separators with filter elements used to remove any oil mist remaining after the gas passes through the vortex separator. The oil removed in the vortex separator can be returned to supply 30 by conventional means, not shown.

In the operation of the device a gas, such as air, from inlet 46 is compressed in compressor 48 and passes through outlet 50 to a conventional cooling heat exchanger, not shown. The gas from the cooling heat exchanger enters inlet 52 and is expanded in the expander portion 54 of the rotary vane cooling system. The expanded gas then passes from outlet 56 to an environmental control heat exchanger, not shown. Oil supplied to slots 18 which passes vanes 18 is removed by oil separators 42 and 44. The apparatus of the invention is capable of higher velocity operation than conventional rotary vane cooling apparatus.

There is thus provided a reverse Brayton cycle rotary vane cooling system which will permit operation at higher rotational speeds and will therefore provide a high cooling/weight ratio.

We claim:

1. A rotary vane gas cycle cooling system, comprising: a compressor and an expander driven by a common shaft, said compressor and expander including a rotor, rotatably mounted on said shaft; said rotor having radially slidable vanes which form a plurality of cells which change in volume as the rotor rotates; said vanes being positioned in vane slots in the rotor and being supported on roller bearings; said rotor being positioned within a housing including vane bearing guide cams adjacent the ends of said vanes; said vanes being constructed of a carbon epoxy plastic composite material; a pair of bearing support inserts molded into the plastic composite on opposite sides of the vanes; means, for reducing friction and wear between said vanes and said rotor within said vane slots.

2. The device as recited in claim 1 including means, passing through the vanes and the bearing support inserts for securing the bearing support inserts on one side of the vanes to the bearing support inserts on the other side of the vanes.

3. The device as recited in claim 2 wherein said means for reducing friction and wear between the vanes and the rotor includes means for supplying oil to the vane slots; means, in the compressor outlet and the expander outlet for removing oil from the gas passing through the outlets.

* * * * *